US010167828B2

(12) United States Patent
Morimoto

(10) Patent No.: US 10,167,828 B2
(45) Date of Patent: Jan. 1, 2019

(54) INTERNAL COMBUSTION ENGINE

(71) Applicant: HONDA MOTOR CO., LTD., Tokyo (JP)

(72) Inventor: Tatsuya Morimoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/668,920

(22) Filed: Aug. 4, 2017

(65) Prior Publication Data

US 2018/0045146 A1 Feb. 15, 2018

(30) Foreign Application Priority Data

Aug. 9, 2016 (JP) ..... 2016-156938

(51) Int. Cl.

| | |
|---|---|
| ***F02M 35/10*** | (2006.01) |
| ***F02M 35/104*** | (2006.01) |
| ***F02M 26/01*** | (2016.01) |
| ***F02M 35/04*** | (2006.01) |

(52) U.S. Cl.

CPC ..... *F02M 35/104* (2013.01); *F02M 26/01* (2016.02); *F02M 35/04* (2013.01); *F02M 35/048* (2013.01); *F02M 35/10288* (2013.01)

(58) Field of Classification Search

CPC ..... F02M 35/04; F02M 35/048; F02M 35/10091; F02M 35/1015; F02M 35/104; F02M 35/112; F02M 35/1283; F02M 35/1277; F02M 35/161

See application file for complete search history.

(56) References Cited

U.S. PATENT DOCUMENTS

| | | | | |
|---|---|---|---|---|
| 6,584,946 | B2 * | 7/2003 | Cardno | F02B 75/22 123/184.34 |
| 9,651,006 | B2 * | 5/2017 | Kilby | F02M 35/161 |
| 2002/0046725 | A1 * | 4/2002 | Ogata | B29C 65/06 123/184.61 |
| 2004/0159302 | A1 * | 8/2004 | Horibe | F02M 35/10078 123/195 C |
| 2005/0076874 | A1 * | 4/2005 | Nakamura | F02M 35/10111 123/184.42 |
| 2006/0000437 | A1 * | 1/2006 | Kito | F02M 35/10019 123/184.21 |
| 2006/0016414 | A1 * | 1/2006 | Kogawa | F02M 35/10052 123/184.42 |
| 2006/0162699 | A1 * | 7/2006 | Schreeck | F02M 35/024 123/468 |

(Continued)

FOREIGN PATENT DOCUMENTS

| | | | | |
|---|---|---|---|---|
| JP | 2017194008 A | * | 10/2017 | B60K 15/01 |
| WO | 2012014378 A1 | | 2/2012 | |

*Primary Examiner* — Thomas Moulis
(74) *Attorney, Agent, or Firm* — Armstrong Teasdale LLP

(57) ABSTRACT

In an internal combustion engine for a vehicle, a fuel delivery pipe (37) is favorably protected from a load of a frontal crash. An intake chamber member (42) positioned in an upper part of an intake manifold (31) is supported by an engine main body (11) via a first support member (50) and a second support member (51) at laterally spaced apart parts of the intake chamber member. A lower part of the intake manifold is connected to a cylinder head of the engine via downstream ends of branch pipes (43) of the intake manifold. The fuel delivery pipe extends laterally between an intake side of the engine main body and the branch pipes.

8 Claims, 11 Drawing Sheets

(56) References Cited

U.S. PATENT DOCUMENTS

| | | | | |
|---|---|---|---|---|
| 2009/0071431 | A1* | 3/2009 | Fujimori | F02M 35/10262 123/184.55 |
| 2010/0147273 | A1* | 6/2010 | Akiyama | F01M 13/0416 123/572 |
| 2010/0288247 | A1* | 11/2010 | Tanikawa | F02M 35/10039 123/568.11 |
| 2010/0294225 | A1* | 11/2010 | Randall | F02M 35/10078 123/184.21 |
| 2010/0294226 | A1* | 11/2010 | Gupta | F02M 35/10078 123/184.21 |
| 2012/0247415 | A1* | 10/2012 | Kim | F02M 35/10216 123/184.21 |
| 2013/0118433 | A1* | 5/2013 | Tochizawa | F02M 35/10026 123/184.21 |
| 2014/0352642 | A1* | 12/2014 | Kilby | F02F 7/006 123/184.21 |
| 2016/0169171 | A1* | 6/2016 | Newman | F02M 35/10373 180/68.3 |
| 2017/0074219 | A1* | 3/2017 | Nola | F02M 35/104 |
| 2017/0152777 | A1* | 6/2017 | Kashiwabara | F01M 13/0011 |
| 2017/0306909 | A1* | 10/2017 | Tanaka | B60K 15/01 |

* cited by examiner 1
11
12
18A
18C
19
22
30
30A
31
34
37
38
41
41B
42
42A
42B
43
43
44
46
50
51
51A
51B
53
55
56
63
64
65
66
67
69A
69B
71
72
73
75
77
80
80A 12
30
30A
46
41
41B
42A
42
63
59
50
59
63
VI
VI
37
44
43
31
42B
75
51B
19
69B
69A
1
51A
22
70A
70B
18A
18
11

INTERNAL COMBUSTION ENGINE

TECHNICAL FIELD

The present invention relates to an internal combustion engine for a vehicle, and in particular to a protection structure for a fuel delivery pipe.

BACKGROUND ART

In an internal combustion engine mounted laterally on a vehicle with the intake side of the engine facing forward, it is known to extend the branch pipes of an intake manifold from the front side of the cylinder head in a forward and upward direction along an arcuate path, and position a fuel delivery pipe for distributing fuel to a plurality of fuel injectors of the engine between the branch pipes and the front side of the cylinder head. See WO2012/014378A1, for instance.

According to this prior art, an intake chamber member forming an upper end part of the intake manifold is connected to the free ends of the branch pipes so that the intake manifold is required to have a high level of stiffness in order for the intake manifold to support a load caused by a frontal crash of the vehicle. As a result, the weight of the intake manifold has to be increased, and the manufacturing cost rises. Therefore, there is a desire to favorably protect a fuel delivery pipe from a load caused by a frontal crash of the vehicle without unduly increasing the weight of the intake manifold.

SUMMARY OF THE INVENTION

In view of such a problem of the prior art, a primary object of the present invention is to provide an internal combustion engine for a vehicle in which a fuel delivery pipe is favorably protected from a load of a frontal crash.

To achieve such an object, the present invention provides an internal combustion engine for a vehicle, comprising: an engine main body (11) having an intake side (18A) disposed on a front side of the vehicle; an intake manifold (31) including a plurality of branch pipes (43) extending from first ends attached to the intake side of the engine main body to second ends in a forward and upward direction along an arcuate path, an intake chamber member (42) connected to the second ends of the branch pipes and elongated in a lateral direction of the vehicle and a trunk pipe (41) extending from the intake chamber member in the lateral direction; a fuel delivery pipe (37) disposed between the intake side of the engine main body and the branch pipes and extending in the lateral direction; a first support member (50) connected to one end portion of the intake chamber member with respect to the lateral direction and the engine main body; and a second support member (51) connected to another end portion of the intake chamber member remote from the one end portion with respect to the lateral direction of the vehicle and the engine main body.

According to this arrangement, because the lower end of the intake manifold or the downstream ends of the branch pipes are connected to the engine main body, and the upper end of the intake manifold or the intake chamber member is connected to the engine main body via the first support member and the second support member, the intake manifold is highly resistant to deformation against a load caused by a frontal crash. Further, because the intake chamber member elongated in the lateral direction is supported at the lateral ends thereof which are spaced apart from each other, the capability of the intake manifold to withstand a load caused by a frontal crash is enhanced. As a result, the fuel delivery pipe positioned behind the branch pipes is favorably protected from a loading at the time of a frontal crash.

In a preferred embodiment of the present invention, the engine main body is formed with an internal EGR passage (34) having an opening that opens out to the intake side of the engine main body, and an EGR introduction hole (54) is formed in the trunk pipe, the first support member (50) abutting the engine main body, the intake chamber member and the trunk pipe, and being provided with a connection passage (57) communicating the internal EGR passage with the EGR introduction hole.

According to this arrangement, the first support member functions not only as a structural member but also as a passage forming member for defining the connection passage communicating the internal EGR passage with the EGR introduction hole so that the number of components can be reduced. The first support member is able to support both the intake chamber member and the trunk pipe.

Preferably, the one end portion of the intake chamber member and a part of the trunk pipe surrounding the EGR introduction hole jointly define a continuous fastening seat surface (53), and the first support member is fastened to the fastening seat surface.

Thereby, the fastening of the first support member with the intake chamber member is facilitated. Also, because the first support member is joined to the intake manifold over a large surface area ranging from the intake chamber member to the trunk pipe, the intake manifold can be supported in a highly stable manner.

Preferably, the first support member (50) includes a rear fastening portion (55) formed in a rear part thereof to be fastened to the engine main body and a front fastening portion (56) formed in a front part thereof to be fastened to the fastening seat surface, wherein the front fastening portion projects upward relative to the rear fastening portion, and is connected to an upper surface of the rear fastening portion via a reinforcement rib (64).

Thereby, the first support member can support the intake chamber member positioned in a relative upper part of the intake manifold with the front fastening portion that extends upward from the rear fastening portion fastened to the engine main body. The stiffness of the first support member can be enhanced by connecting the front fastening portion and the rear fastening portion with the reinforcement rib.

In a preferred embodiment of the present invention, the intake side of the engine main body is provided with a support table (67) projecting forward and defining a planar upper surface, and the second support member (61) is fastened to the upper surface of the support table via at least two vertically extending threaded bolts (69A, 69B), wherein the engine main body is provided with a stopper (72) configured to abut the second support member when the second support member has rotated from an initial position toward the engine main body around one of the threaded bolts.

According to this arrangement, a part of the load applied to the intake manifold at the time of a frontal crash is absorbed by the fracture of one of the threaded bolts. The stopper prevents the rotation of the second support member beyond a prescribed angular position so that the rearward deformation of the intake manifold can be favorably controlled. This also contributes to the prevention of contact between the intake manifold and the fuel delivery pipe.

The second support member and the intake chamber member may abut each other in a fore and aft direction of the vehicle.

Thus, the second support member supports the intake chamber member from the rear so that the rearward displacement of the intake manifold can be favorably controlled.

The intake manifold may be formed by a plurality of pieces (85-87) while the first support member and the second support member are both connected to a same one of the pieces (85) of the intake manifold.

According to this arrangement, one of the pieces of the intake manifold is supported by both of the first support member and the second support member in a stable manner, and this piece of the intake manifold in turn supports the remaining pieces of the intake manifold so that the rearward displacement of the intake manifold can be favorably controlled.

Preferably, the one (85) of the plurality of pieces of the intake manifold to which the first support member and the second support member are both connected has a greater stiffness than the other pieces (86, 87), and is located in a rearmost part thereof.

Thereby, the piece of the intake manifold connected to both of the first support member and the second support member favorably resists the rearward displacement of the intake manifold owing to the greater stiffness thereof, and the impact energy of a frontal crash can be favorably absorbed by the fracture and deformation of the remaining pieces of the intake manifold which are less stiff and positioned in a front part of the intake manifold.

Thus, in an internal combustion engine for a vehicle, a fuel delivery pipe can be favorably protected from a load of a frontal crash.

BRIEF DESCRIPTION OF THE DRAWING(S)

Figure 10A:
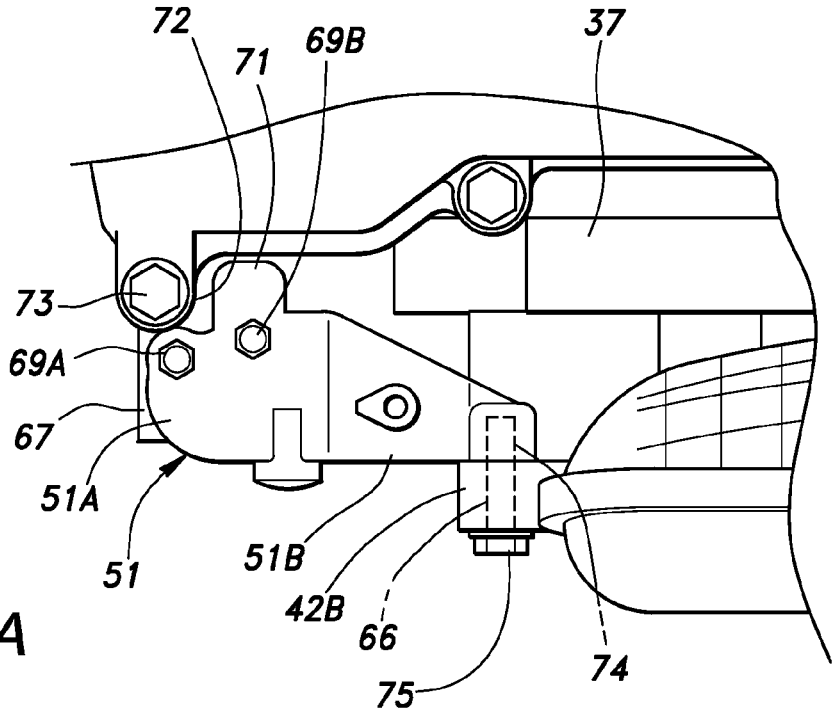
Figure 10B:
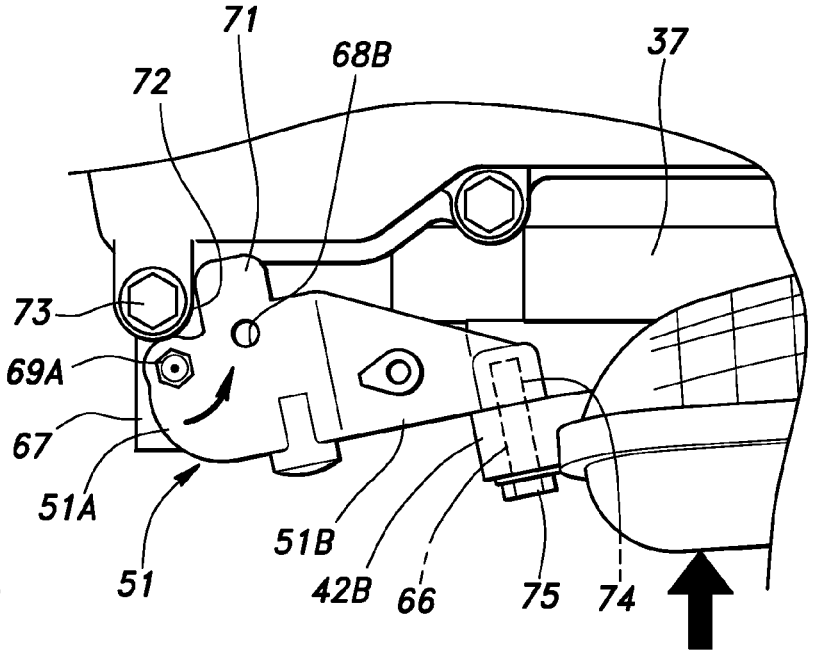
Figure 11A:
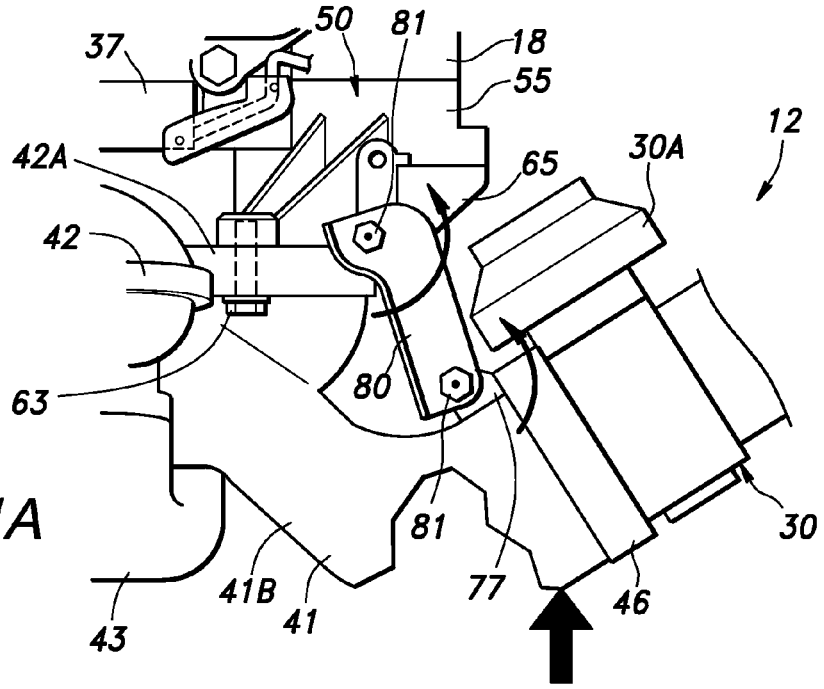
Figure 11B:
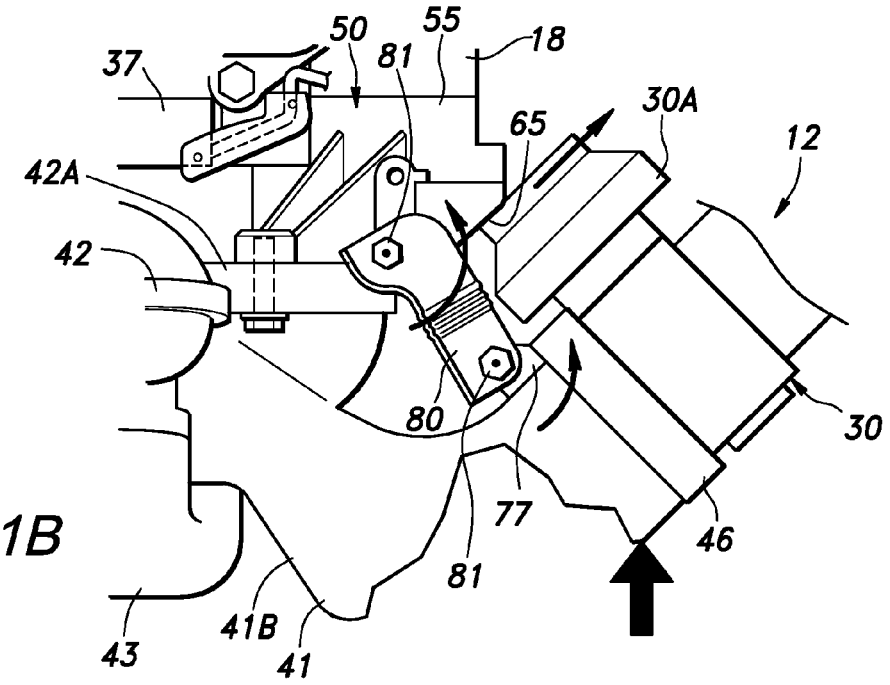

FIG. 10*a* is a plan view of the second support member before a frontal crash;

FIG. 10*b* is a view similar to FIG. 10*a* after the frontal crash;

FIG. 11*a* is a plan view of a throttle valve and a surrounding region when a trunk pipe has ruptured and a throttle valve has traveled rearward in an early phase of a frontal crash; and FIG. 11*b* is a view similar to FIG. 11*a* when the throttle valve has traveled further rearward and has come into contact with a guide portion in a later phase of the frontal crash.

DESCRIPTION OF THE PREFERRED EMBODIMENT(S)

A preferred embodiment of the present invention is described in the following with reference to the appended drawings. The directions mentioned in the following disclosure are defined with respect to a vehicle on which an internal combustion engine embodying the present invention is mounted.

Figure 1:
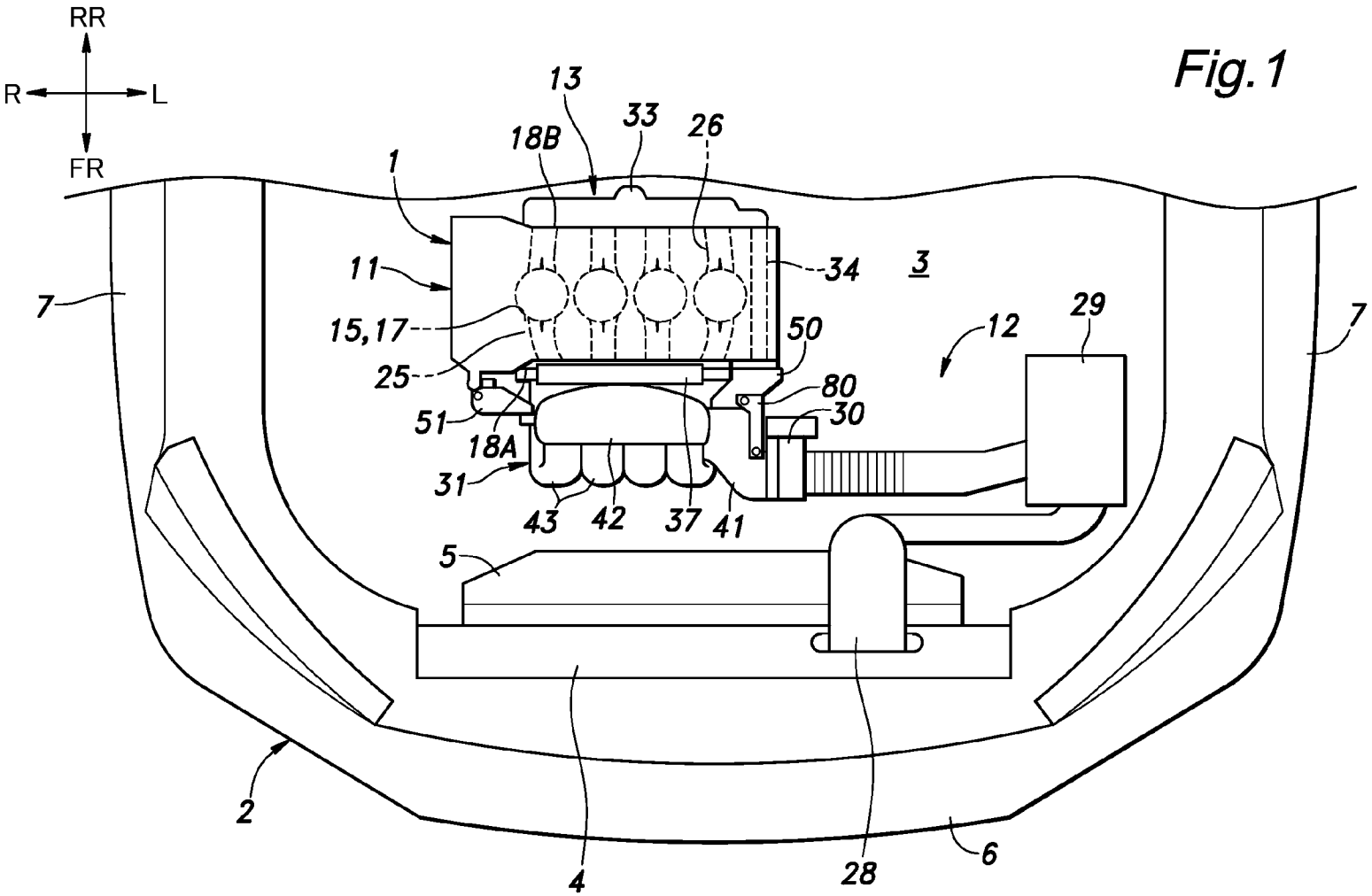
FIG. 1 is a plan view of a front part of a vehicle provided with an internal combustion engine embodying the present invention.

As shown in FIG. 1, an internal combustion engine 1 for an automobile is disposed in an engine room 3 formed in a front portion of a vehicle 2. On the front side of the engine room 3 of the vehicle 2, a substantially rectangular frame-like bulkhead 4 having an opening facing in the fore and aft direction is provided. A radiator 5 for cooling the cooling water circulating through the internal combustion engine 1 is supported at a rear portion of the bulkhead 4. A front part of the engine room 3 is defined by a front bumper face 6 arranged on the front side of the bulkhead 4 and the left and right side parts of the engine room 3 are defined by respective front fenders 7.

Figure 2:
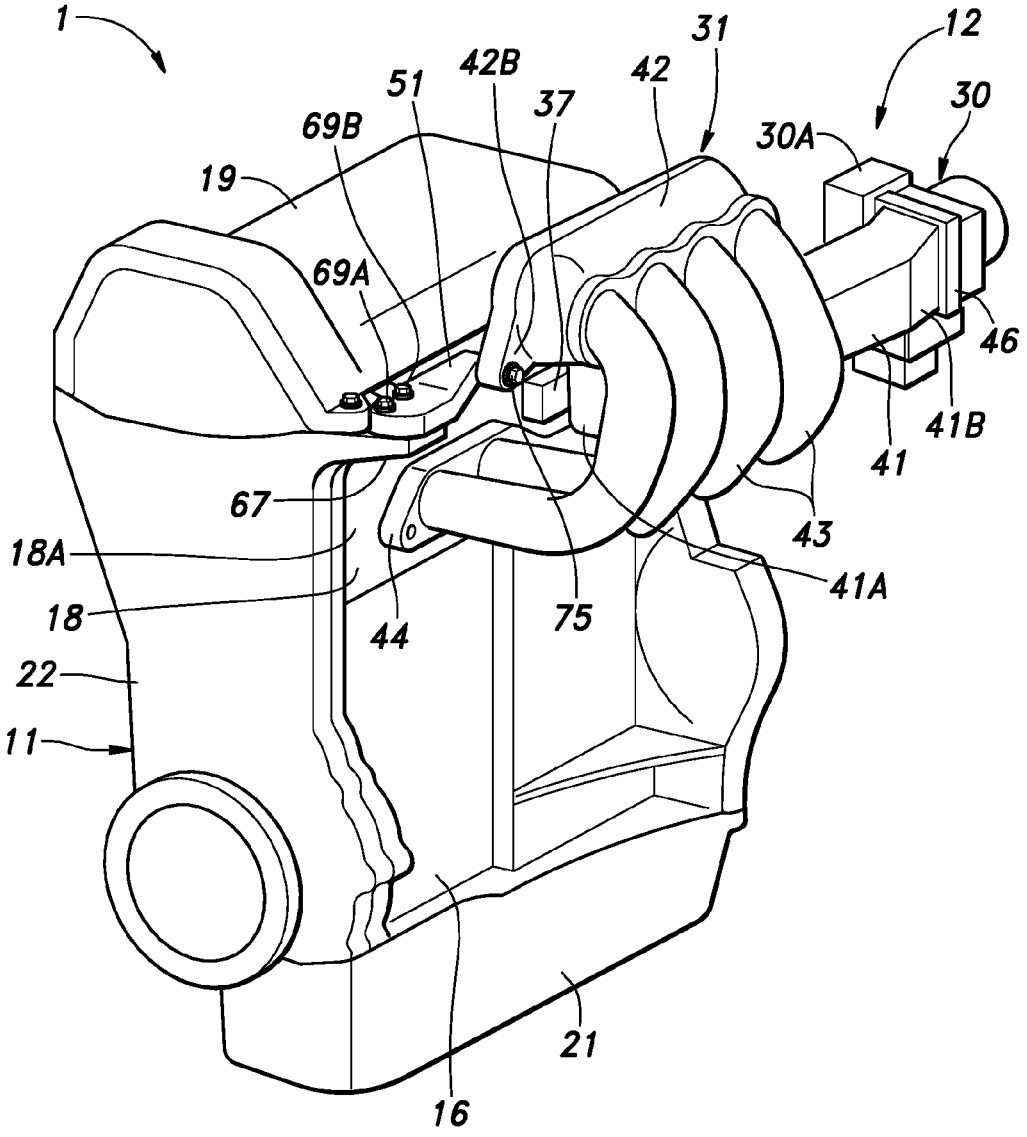
FIG. 2 is a perspective view of the engine as seen from a forward and rightward direction.

The internal combustion engine 1 includes a main body 11, an intake device 12 and an exhaust device 13 coupled to the engine main body 11. As shown in FIG. 2, the engine main body 11 includes a cylinder block 16 having a plurality of cylinders 15 formed therein, a cylinder head 18 coupled to an upper end of the cylinder block 16 and formed with combustion chamber recesses 17 corresponding to the cylinders 15, a head cover 19 coupled to the upper end of the cylinder head 18, an oil pan 21 coupled to a lower end of the cylinder block 16, and a chain case 22 connected to a cylinder row end of the cylinder block 16, the cylinder head 18 and the head cover 19. The chain case 22 defines a space accommodating a timing chain coupled between a camshaft and a crankshaft, in cooperation with the cylinder block 16, the cylinder head 18 and the head cover 19.

As shown in FIG. 1, the engine main body 11 is positioned behind the radiator 5, and is arranged in the engine room 3 laterally so that the cylinder row extends in the widthwise direction of the vehicle. An intake port 25 and an exhaust port 26 extending from each combustion chamber recess 17 are formed in the cylinder head 18. The intake port 25 opens to the intake side 18A (the front side) of the cylinder head 18 extending along the cylinder row direction, and the exhaust port 26 opens to the exhaust side 18B (the rear side) of the cylinder head 18 extending along the cylinder row direction.

The intake device 12 internally defines a series of passages for supplying fresh air to the cylinders 15 of the engine 1, and includes an air inlet 28, an air cleaner 29, a throttle valve 30, and an intake manifold 31, in this order from the upstream end. The air inlet 28 is supported on the upper portion of the bulkhead 4, and the air cleaner 29 is disposed on the left rear side of the radiator 5. The throttle valve 30 and the intake manifold 31 are disposed behind the radiator 5. The intake device 12 is attached to the intake side 18A of the cylinder head 18 via the intake manifold 31, and communicates with the intake ports 25.

The exhaust device 13 includes an exhaust manifold 33 attached to the exhaust side 18B of the cylinder head 18, an exhaust gas purification device, a muffler, and an exhaust outlet, in this order from the upstream end. A left end part of the cylinder head 18 internally defines an internal EGR passage 34 passed through from the exhaust side 18B to the intake side 18A. The exhaust manifold 33 is connected to the rear end of the internal EGR passage 34.

Figure 6:
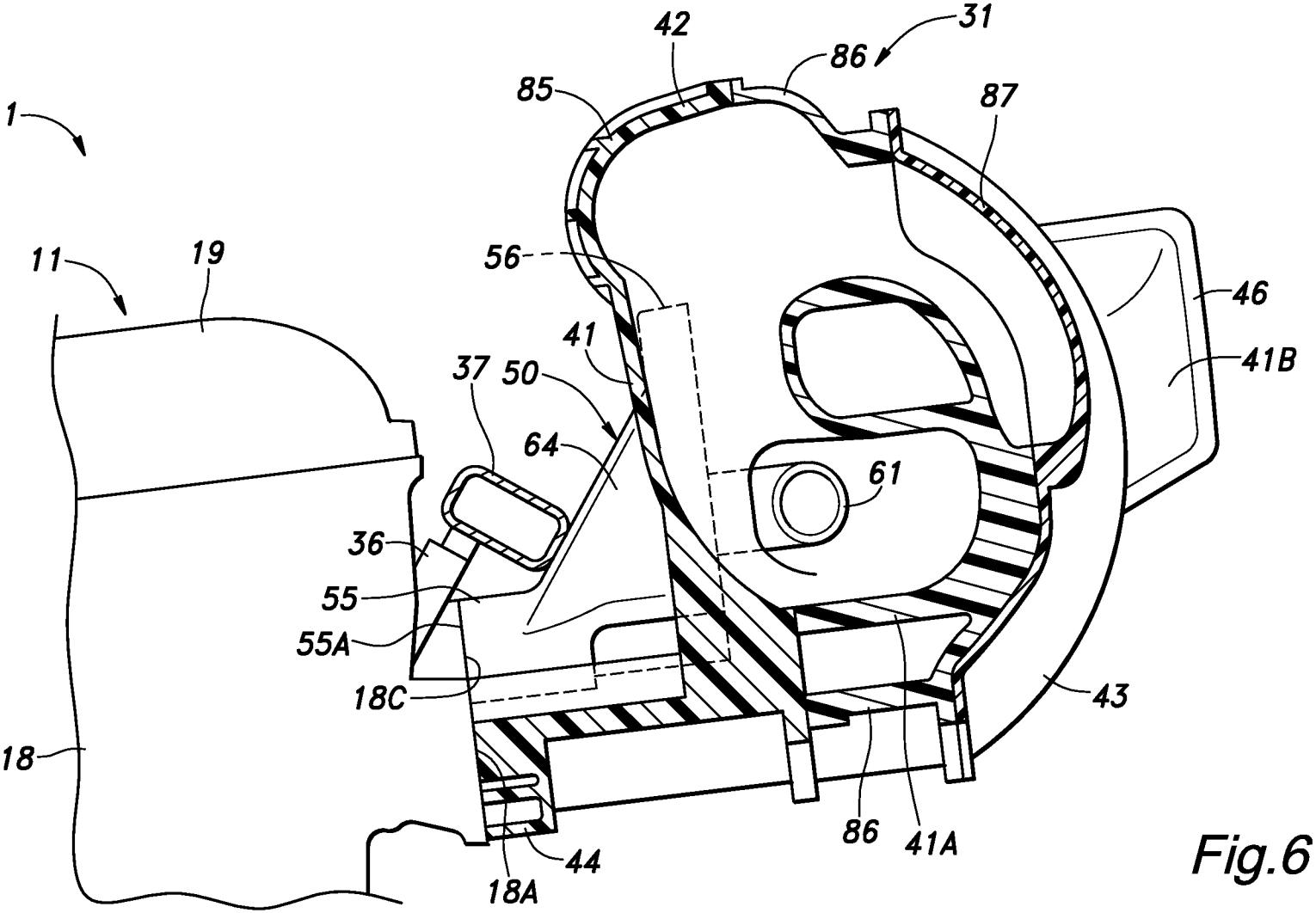
FIG. 6 is a sectional view taken along line VI-VI of FIG. 4.

On the intake side 18A of the cylinder head 18, fuel injectors 36 are passed into the respective combustion chamber recesses 17 (see FIG. 6). The inner end of each fuel injector 36 is provided with an injection hole, and protrudes into the corresponding combustion chamber recess 17 while the outer end of the fuel injector 36 protrudes forward on the intake side 18A. As shown in FIGS. 1 to 4, a fuel delivery pipe 37 extending in the width-wise direction of the vehicle is disposed in front of the intake side 18A, and the outer ends of the respective fuel injectors 36 are connected to the fuel delivery pipe 37. A fuel supply pipe 38 having a smaller cross-sectional area than the fuel delivery pipe 37 is connected to the left end of the fuel delivery pipe 37 (see FIG. 3). The fuel supply pipe 38 is connected to a fuel tank via a fuel pump (not shown in the drawings).

As shown in FIGS. 2 to 5, the intake manifold 31 includes a trunk pipe 41, an intake chamber member 42, and a plurality of branch pipes 43. One ends of the branch pipes 43 are connected to a common branch pipe flange 44 extending in the cylinder row direction and fastened to the intake side 18A of the cylinder head 18. Each branch pipe 43 extends from the one end connected to the intake side 18A of the cylinder head 18 along a curved path having a convex side facing in a forward and upward direction. The branch pipes 43 are arranged one next to the other in the lateral direction of the vehicle. Each branch pipe 43 includes a linear section extending from the branch pipe flange 44 by a prescribed length.

The intake chamber member 42 is provided with a box shape elongated in the lateral direction of the vehicle. The intake chamber member 42 internally defines a chamber having a larger cross sectional area than the trunk pipe 41. The upper end of each branch pipe 43 is connected to the front side of the intake chamber member 42. The portions at which the branch pipes 43 are connected to the intake chamber member 42 are arranged in a row extending in the lateral direction of the vehicle.

The trunk pipe 41 extends from the intake chamber member 42 in the lateral direction of the vehicle. More specifically, one end of the trunk pipe 41 is connected to a central portion of the lower wall of the intake chamber member 42 with respect to the lateral direction of the vehicle, extends downward from the intake chamber member 42, and bends rightward. The downstream portion 41A of the trunk pipe 41 is disposed under the intake chamber member 42 and behind two of the branch pipes 43, and the upstream portion 41B of the trunk pipe 41 extends beyond the leftmost branch pipe 43. The front portion of the downstream portion 41A of the trunk pipe 41 is integrally formed with some of the branch pipes 43 arranged on the left side.

A portion of the upstream portion 41B of the trunk pipe 41 extending leftward beyond the branch pipes 43 protrudes progressively forward toward the left end (upstream end) thereof. A trunk pipe flange 46 extends radially from the upstream end (left end) of the trunk pipe 41, and a throttle valve 30 is attached to the trunk pipe flange 46 with threaded bolts. The throttle valve 30 is provided with a per se known structure, and includes, for example, a casing 30A that defines an intake passage, a butterfly valve supported by the casing 30A, and an electric motor that drives the butterfly valve. The casing 30A of the throttle valve 30 has higher stiffness than the trunk pipe 41. The upstream side of the casing 30A of the throttle valve 30 is connected to the air cleaner 29 via a pipe that internally defines an intake passage.

Figure 3:
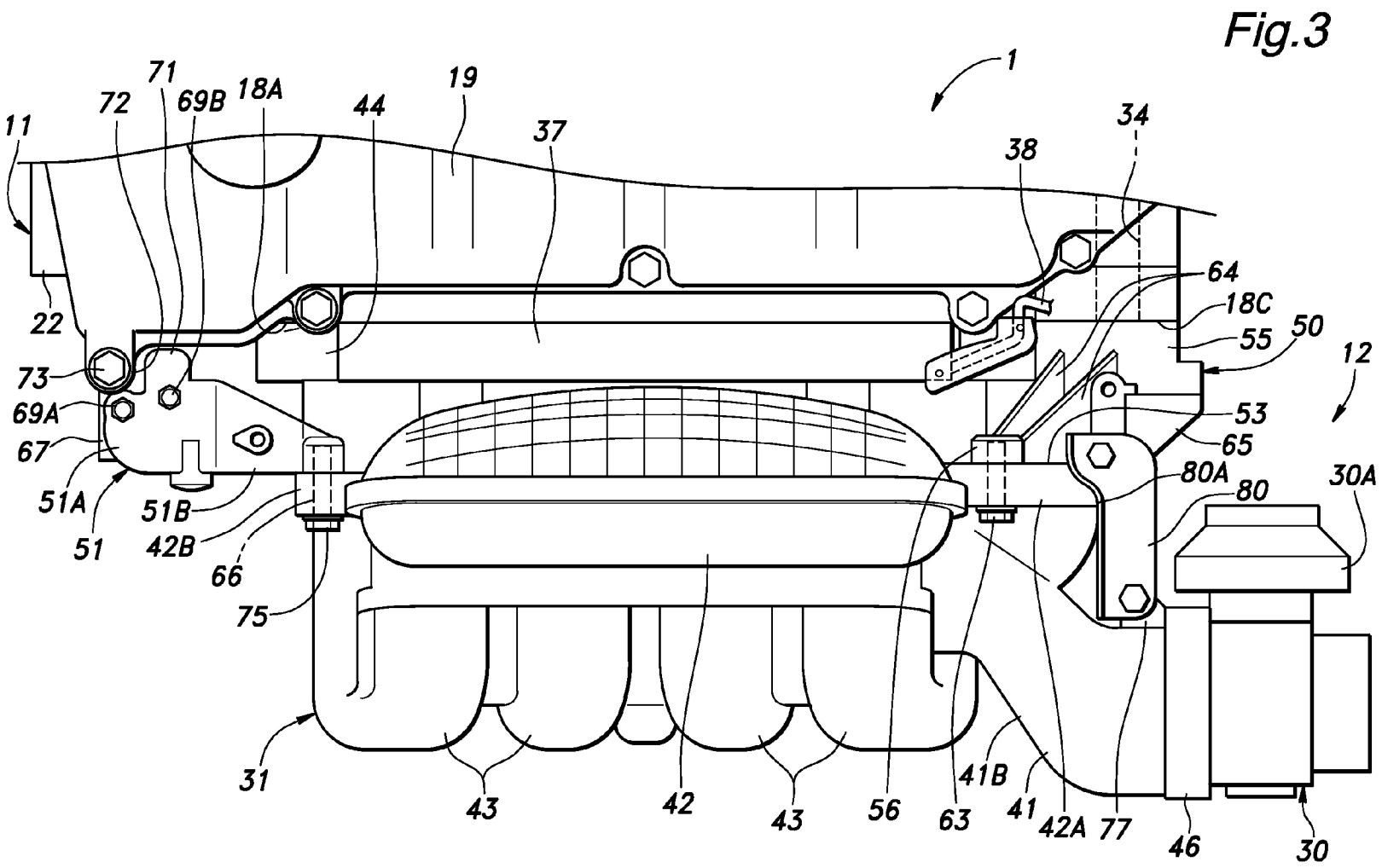
FIG. 3 is a plan view of a front part of the engine.
Figure 4:
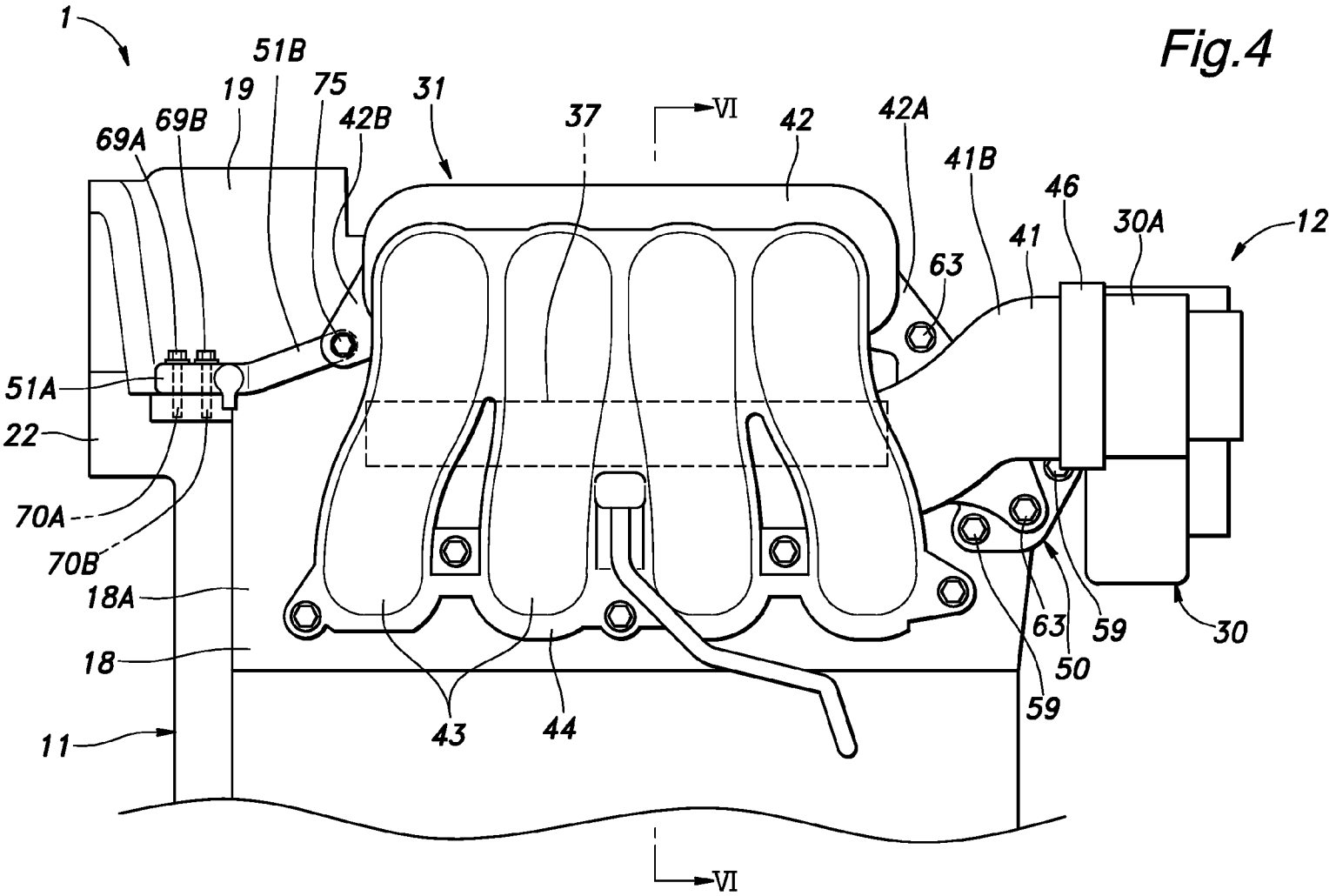
FIG. 4 is a front view of an upper front part of the engine.
Figure 5:
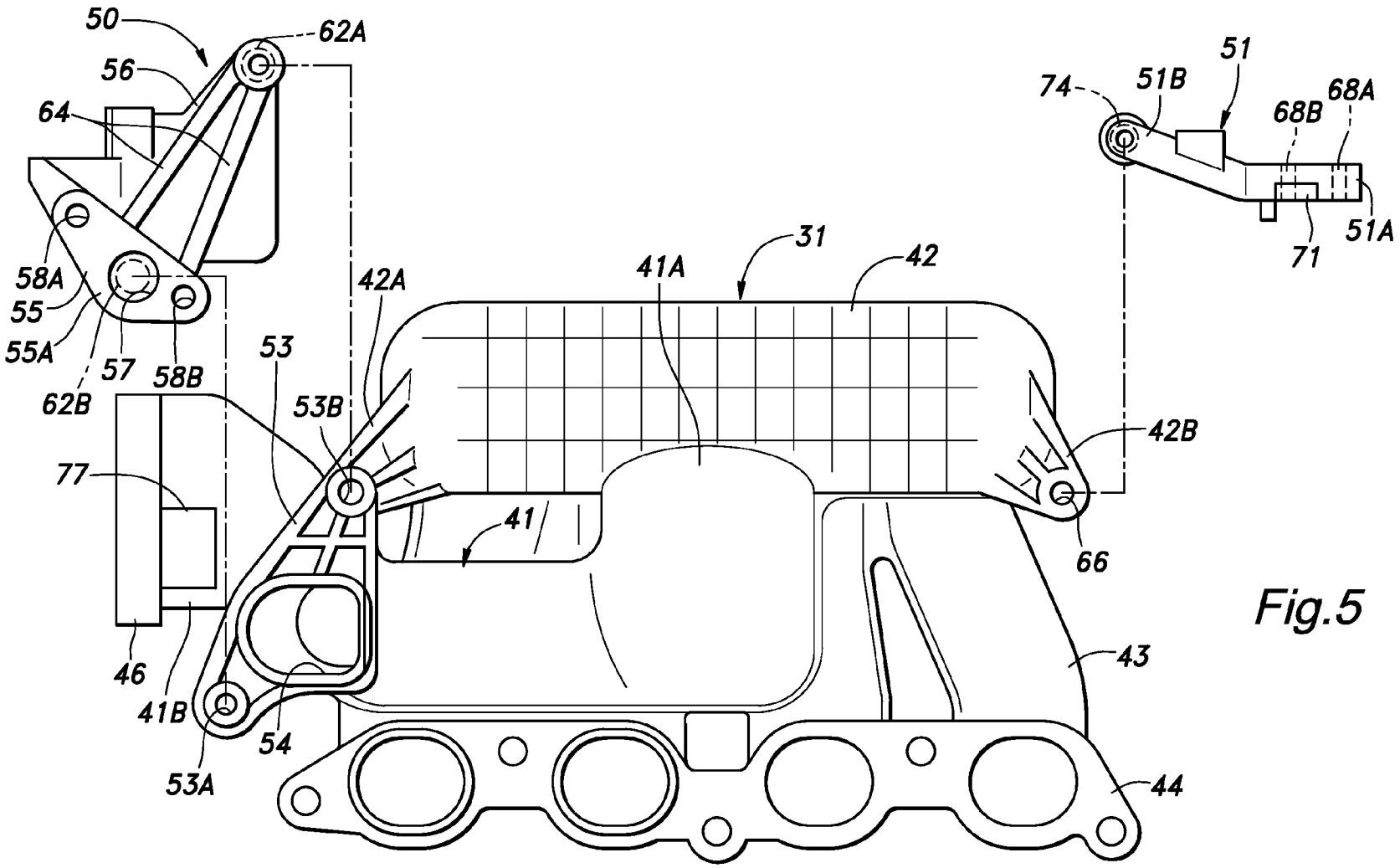
FIG. 5 is a rear view of an intake manifold.

As shown in FIGS. 3 to 5, the left end portion (which is one end portion in the lateral direction of the vehicle) of the intake chamber member 42 and the trunk pipe 41 are attached to the intake side 18A of the cylinder head 18 via a first support member 50. Further, the right end portion (which is the other end portion in the lateral direction of the vehicle) of the intake chamber member 42 is attached to the intake side 18A of the cylinder head 18 via a second support member 51.

As shown in FIG. 5, the intake chamber member 42 is provided with a left chamber extension 42A protruding to a leftward and downward direction and connected to the rear side of the trunk pipe 41 at the left end portion of the rear side thereof. The left chamber extension 42A and a rear part of the trunk pipe 41 jointly define a left side fastening seat surface 53 facing rearward. The left side fastening seat surface 53 forms a planar fastening surface facing rearward. A hole or a recess may be formed in an appropriate part of the left chamber extension 42A for reducing the weight. In a part of the left side fastening seat surface 53, an EGR introduction hole 54 is bored into the fastening surface in the fore and aft direction so as to reach the interior of the trunk pipe 41. The left side fastening seat surface 53 extends downward and to the left beyond the EGR introduction hole 54 and the trunk pipe 41, and a bolt hole 53A is passed through the protruding part of the left side fastening seat surface 53. A bolt hole 53B extending in the fore and aft direction is formed in a portion of the left side fastening seat surface 53 corresponding to the left chamber extension 42A and located above the EGR introduction hole 54 and the trunk pipe 41.

Figure 7:
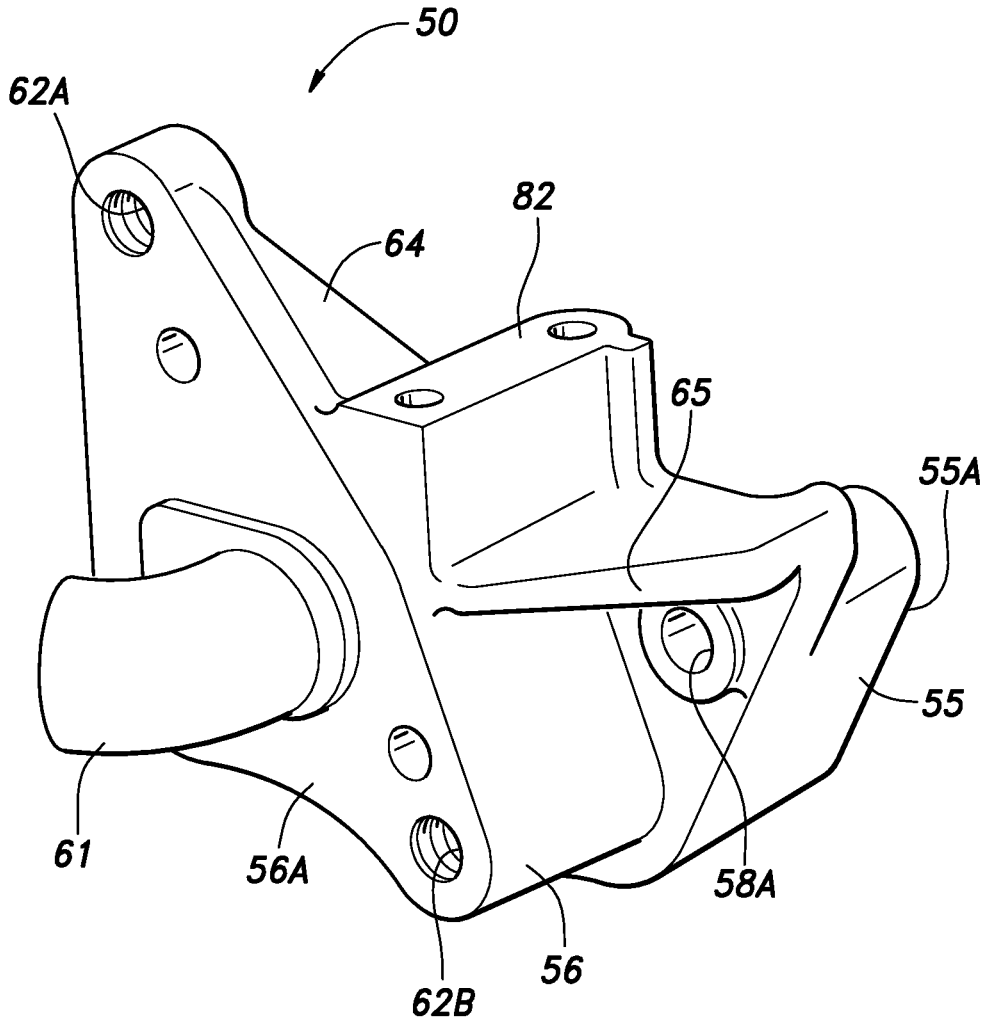
FIG. 7 is a perspective view of a first support member as seen from a forward and leftward direction.
Figure 8:
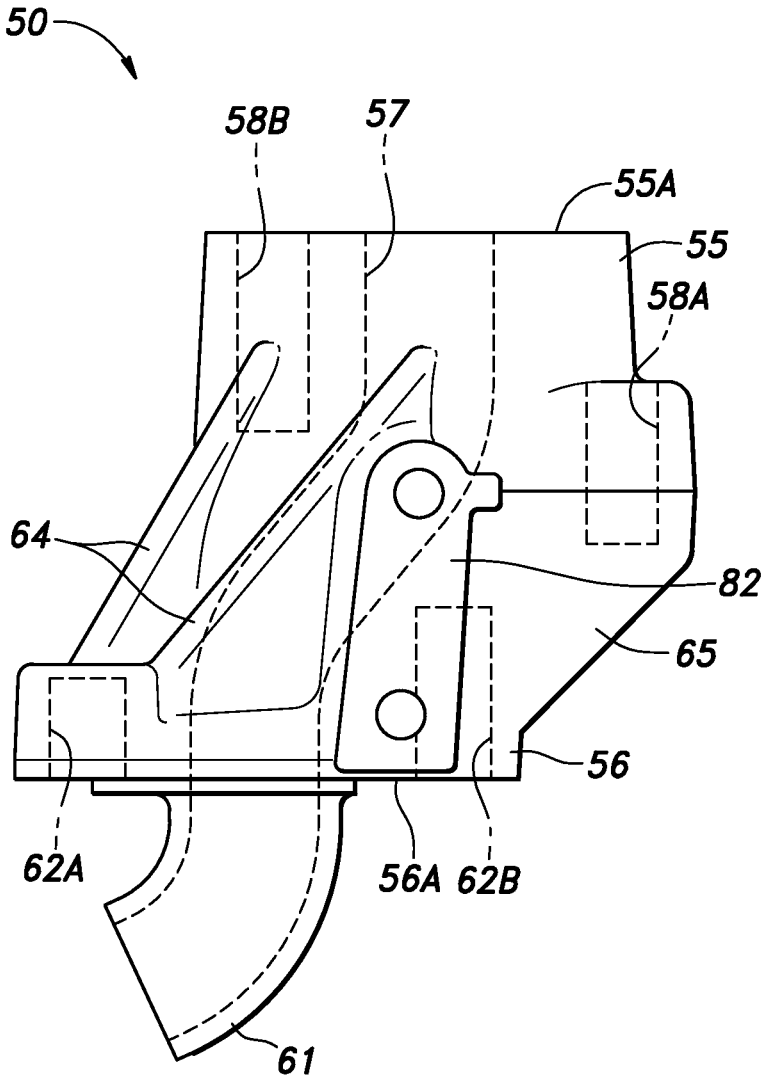
FIG. 8 is a plan view of the first support member.

As shown in FIGS. 7 and 8, the first support member 50 is provided with a rear fastening portion 55 and a front fastening portion 56 provided on the front side of the rear fastening portion 55. The rear end of the rear fastening portion 55 has a rear fastening surface 55A facing rearward, and a front end of the front fastening portion 56 is provided with a planar front fastening surface 56A facing forward. The front fastening portion 56 is offset upward and rightward with respect to the rear fastening portion 55. Similarly, the front fastening surface 56A is offset upward and rightward with respect to the rear fastening surface 55A. The front fastening surface 56A and the rear fastening surface 55A are substantially parallel to each other. Inside the rear fastening portion 55 and the front fastening portion 56, an EGR connection passage 57 is passed through in the fore and aft direction. The rear end of the EGR connection passage 57 opens rearward to the rear fastening surface 55A, and the front end thereof opens forward into the inside of an extension pipe 61 projection from the front fastening surface 56A. An EGR connection passage 57 extends from the rear end opening out to the rear fastening surface 55A to the front end along a path curving upward and downward.

The rear fastening portion 55 extends in the lateral direction of the vehicle, and the EGR connection passage 57 opens at a central part of the rear fastening surface 55A with respect to the lateral direction of the vehicle. A pair of bolt holes 58A and 58B are passed through the lateral end portions of the rear fastening portion 55 in the fore and aft direction. The left bolt hole 58A may be offset vertically relative to the right bolt hole 58B. As shown in FIGS. 3 and 4, the rear fastening surface 55A of the first support member 50 abuts the fastening surface 18C formed around the internal EGR passage 34 on the intake side 18A of the cylinder head 18 via a gasket, and the rear end of the EGR connection passage 57 is connected to the internal EGR passage 34. The first support member 50 is fastened to the cylinder head 18 via threaded bolts 59 which are passed through the respective bolt holes 58A and 58B, and threaded into female threaded holes formed in the fastening surface 18C of the cylinder head 18.

As shown in FIGS. 7 and 8, the front fastening portion 56 extends vertically, and an extension pipe 61 is provided in a central part thereof with respect to the vertical direction of the front fastening surface 56A. A pair of female threaded holes 62A and 62B are formed at two vertical end portions of the front fastening surface 56A, respectively. The upper female threaded hole 62A is disposed to the right of the extension pipe 61, and the lower female threaded hole 62B is disposed to the left of the extension pipe 61. The lower female threaded hole 62B is formed as a blind hole, and is positioned so as to correspond to the rear end of the EGR connection passage 57 as viewed from the front. In other words, the lower female threaded hole 62B is positioned so as to be intermediate between the left and right bolt holes 58A and 58B of the rear fastening portion 55 as viewed from the front. As shown in FIGS. 3 and 4, in the first support member 50, the front fastening surface 56A is brought into contact with the left side fastening seat surface 53 of the intake manifold 31 via a gasket so that the extension pipe 61 is inserted into the EGR introduction hole 54. The first support member 50 is fastened to the intake manifold 31 by threaded bolts 63 and 63 threaded into the corresponding female threaded holes 62A and 62B of the first support member 50 after passing through the bolt holes 53A and 53B of the left side fastening seat surface 53. The free end of the extension pipe 61 is curved in the trunk pipe 41 so as to face in the downstream direction or rightward.

As shown in FIGS. 3 and 4, the upper surface of the rear fastening portion 55 and the rear surface of the portion protruding upward from the rear fastening portion 55 of the front fastening portion 56 are disposed so as to be orthogonal to each other, and are connected to each other by triangular reinforcement ribs 64. The number of the reinforcement ribs 64 may be freely selected, and in the present embodiment, two of the reinforcement ribs 64 are arranged in a laterally spaced apart relationship.

A guide portion 65 projects leftward from the left surface of the front fastening portion 56. The guide portion 65 is formed as a plate portion having a major plane facing vertically, and an edge portion thereof protruding to the left is inclined so as to protrude leftward (laterally outward direction of the vehicle) toward the rear end thereof. The rear end of the guide portion 65 is connected to the front surface of the rear fastening portion 55. The guide portion 65 defines the left side edge of the first support member 50 and is inclined so as to slant leftward toward the rear. The guide portion 65 also functions as a reinforcing structure for the first support member 50. The left bolt hole 58A of the rear fastening portion 55 is disposed under the guide portion 65.

The intake chamber member 42 is provided with a right chamber extension 42B protruding to the right and downward at the rear right end portion thereof. A reinforcing rib may be formed on the surface of the right chamber extension 42B. A bolt hole 66 extending in the fore and aft direction is passed through the right chamber extension 42B.

As shown in FIGS. 2 to 4, a part of the engine main body 11 which is located behind the right chamber extension 42B is provided with a support table 67 protruding forward along the intake side 18A of the cylinder head 18. In the illustrated embodiment, the support table 67 is integrally formed with the chain case 22 and extends forward from the front edge portion of the chain case 22 beyond the intake side 18A. The support table 67 is preferably in contact with the intake side 18A. Alternatively, the support table 67 may protrude from the cylinder head 18 or the cylinder block 16. The support table 67 has a planar upper surface facing upward.

Figure 9:
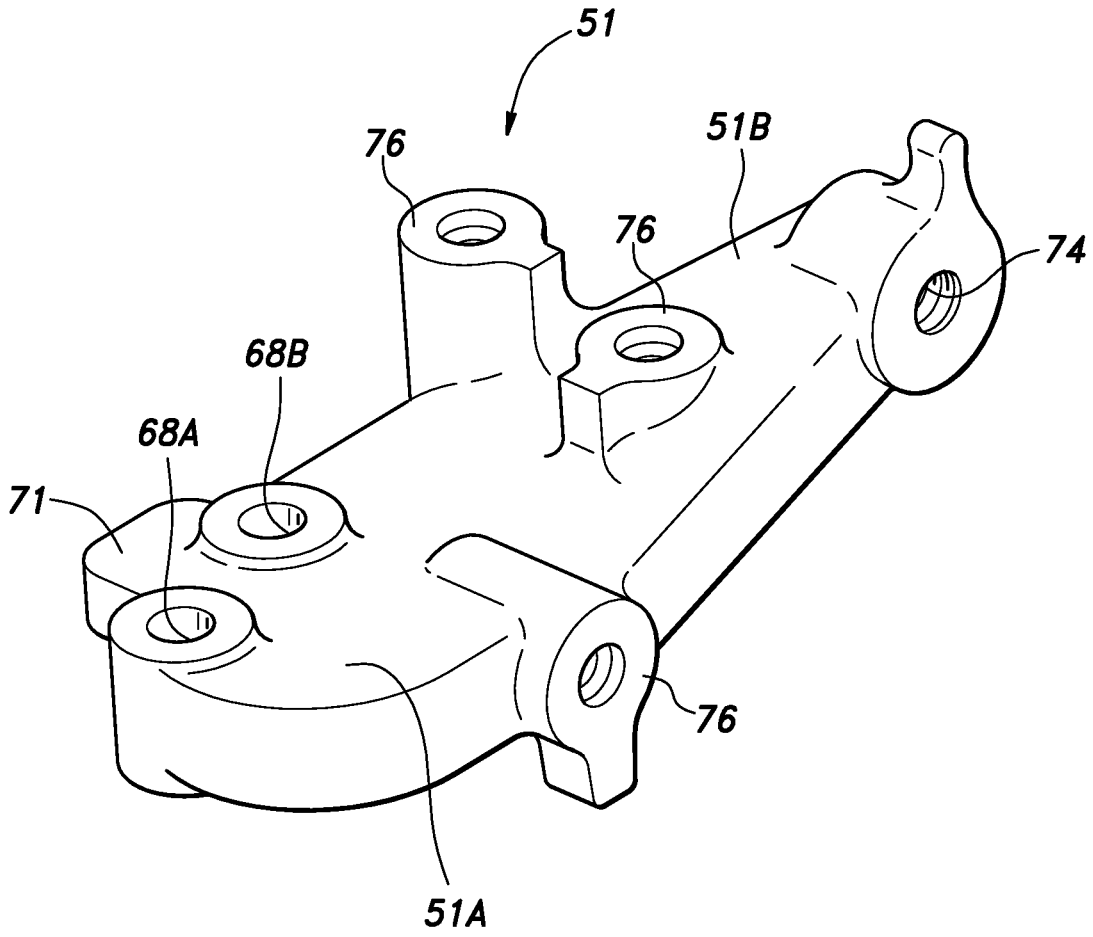
FIG. 9 is a perspective view of a second support member as seen from a forward and rightward direction.

As shown in FIG. 9, the second support member 51 is a plate like member having a prescribed thickness. The second support member 51 is elongated laterally and is attached to the upper surface of the support table 67 at a right end portion 51A thereof. The right end portion 51A of the second support member 51 is disposed on the upper surface of the support table 67 such that the major plane thereof faces vertically. A pair of bolt holes 68A and 68B extending vertically (thickness-wise direction) are passed through the right end portion 51A of the second support member 51. The second support member 51 is fastened to the upper surface of the support table 67 by inserting a pair of threaded bolts 69A and 69B into the respective bolt holes 68A and 68B from above, and threading the two threaded bolts 69A and 69B into corresponding female threaded holes 70A and 70B formed on the upper side 9 of the support table 67.

A projecting piece 71 projects rearward from the rear edge of the second support member 51. As shown in FIG. 3, a stopper 72 is positioned above the upper surface of the support table 67 and opposes the projecting piece 71 from the right direction of the projecting piece 71 via a gap. In the present embodiment, the stopper 72 is formed by the side end of the peripheral flange of the head cover 19 attached to the support table 67. The flange of the head cover 19 is connected to the support table 67 by a threaded bolt 73, and the stopper 72 is formed as a peripheral part of the bolt hole formed in the flange. Alternatively, the stopper 72 may consist of a protrusion protruding upward from the upper surface of the support table 67, or a protrusion protruding forward from the intake side 18A of the cylinder head 18. When the second support member 51 is rotated by a predetermined angle around either one of the bolts 69A and 69B such that the left end portion 51B of the second support member 51 moves rearward, the stopper 72 is brought into abutment with the projecting piece 71, and thereby limits the angular movement of the second support member 51 (see FIG. 11).

As shown in FIGS. 3 to 5, the left end portion 51B of the second support member 51 extends to the left while inclining upward with respect to the right end portion 51A, and reaches the rear surface of the right chamber extension 42B. A female threaded hole 74 is formed rearward on the front surface of the left end portion 51B of the second support member 51. The intake chamber member 42 and the second support member 51 are fastened to each other by a threaded bolt 75 that is passed through the bolt hole 66 of the right chamber extension 42B from the front, and is threaded into the female threaded hole 74. The left end portion 51B of the second support member 51 and the right chamber extension 42B are fastened to each other from the fore and aft direction with the threaded bolt 75, and the right chamber extension 42B is supported by the left end portion 51B of the second support member 51 from the rear. As shown in FIG. 9, a coupling portion 76 for engaging a clip that retains a wire harness or a ground wire is formed in a part of the second support member 51. The coupling portion 76 may be formed as a hole or a projection.

As shown in FIGS. 3 and 5, a trunk pipe mounting seat surface 77 is formed in a rear portion of the upstream portion 41B of the trunk pipe 41. The trunk pipe mounting seat surface 77 may be disposed close to the trunk pipe flange 46, and may be connected to the trunk pipe flange 46. The trunk pipe mounting seat surface 77 and the first support member 50 are connected to each other by a connecting member 80. The connecting member 80 is a sheet metal member having a major plane facing vertically, and is and elongated in the fore and aft direction. The connecting member 80 is provided with a side flange 80A bent upward along the right side edge of the main part of the connecting member 80 so as to define an L shaped cross section. The front end of the connecting member 80 is connected to the trunk pipe mounting seat surface 77 so as to be rotatable around an axial line orthogonal to the major plane of the trunk pipe mounting seat surface 77 via a vertically extending threaded bolt 81, and the rear end of the connecting member 80 is connected to the connecting seat surface 82 of the trunk pipe mounting seat surface 77 so as to be rotatable around an axial line orthogonal to the major plane of the connecting seat surface 82 via a vertically extending threaded bolt 81.

As shown in FIGS. 3, 4 and 6, the fuel delivery pipe 37 is disposed in the space defined between the intake side 18A of the cylinder head 18 and the branch pipes 43. In the present embodiment, the fuel delivery pipe 37 is disposed behind the trunk pipe 41 (which is in turn disposed behind the branch pipe 43), and in front of the intake side 18A of the cylinder head 18. The length of the fuel delivery pipe 37 in the lateral direction of the vehicle is substantially equal to the length of the intake chamber member 42 in the lateral direction of the vehicle, and the fuel delivery pipe 37 is disposed so as to align with the intake chamber member 42 in the lateral direction of the vehicle. Further, the fuel delivery pipe 37 is disposed between the first support member 50 and the second support member 51 with respect to the lateral direction of the vehicle. The upper end of the fuel delivery pipe 37 is disposed below the upper end of the first support member 50 and below the lower end of the second support member 51. Further, the fuel delivery pipe 37 is disposed below both the left chamber extension 42A and the right chamber extension 42B.

As shown in FIG. 6, the intake manifold 31 is formed by combining a plurality of plastic members. In the present embodiment, the intake manifold 31 is provided with a main piece 85 constituting a rear portion thereof, a middle piece 86 constituting an intermediate portion with respect to the fore and aft direction and located behind the main piece 85, and a port piece 87 constituting a front portion thereof. More specifically, the main piece 85 forms a portion of the branch pipes 43 on the cylinder head 18 side with respect to the lengthwise direction thereof, a rear portion of the intake chamber member 42, and a rear portion of the trunk pipe 41. The middle piece 86 forms an intermediate portion of the branch pipes 43 with respect to the lengthwise direction, a rear portion of the curved portion of the branch pipes 43, a front portion of the intake chamber member 42, and a front portion of the trunk pipe 41. The port piece 87 constitutes the front portion of the curved portion of the branch pipes 43. The main piece 85, the middle piece 86, and the port piece 87 are coupled to each other by vibration welding or the like, for example. The left side fastening seat surface 53 and the right chamber extension 42B are formed in the main piece 85.

The main piece 85 is formed so as to have a higher stiffness than the middle piece 86 and the port piece 87. Specifically, when the intake manifold 31 is attached to the cylinder head 18, the main piece 85 has a high resistance against a load from the front than the middle piece 86 and the port piece 87. As a result, the main piece 85 deforms only after the port piece 87 and the middle piece 86 have deformed to a significant extent as a result of a load applied from the front side of the intake manifold 31. The main piece 85, the middle piece 86 and the port piece 87 may be given with suitable levels of stiffness by selecting the material, the shape and the thickness.

The behavior of the internal combustion engine 1 described above and the associated advantages of the internal combustion engine 1 at the time of a frontal crash are described in the following. When the vehicle 2 having the internal combustion engine mounted thereon makes a frontal crash, the bulkhead 4 and the radiator 5 are moved rearward by the load from the front, and the impact is transmitted to the intake manifold 31 positioned on the front side of the internal combustion engine 1 via the bulkhead 4 and the radiator 5. Because the intake manifold 31 is connected to the engine main body 11 at the lower end portions of the branch pipes 43 (which are positioned in a lower part of the intake manifold 31) and at the intake chamber member 42 (which is positioned in an upper part of the intake manifold) via the first support member 50 and the second support member 51, the intake manifold 31 is comparatively resistant against deformation at the time of a frontal crash. In particular, because the intake chamber member 42 extending in the lateral direction of the vehicle is attached to the engine main body 11 via the first support member 50 and the second support member 51 positioned in the respective lateral ends of the intake chamber member 42, the resistance to deformation of the intake manifold 31 is enhanced. Thus, the fuel delivery pipe 37 positioned behind a vertically middle part of the intake manifold 31 or the branch pipes 43 and the trunk pipe 41 is favorably protected from the impact of a frontal crash.

Further, since the upstream portion 41B of the trunk pipe 41 is coupled to the cylinder head 18 via the connecting member 80 and the first support member 50 so as to be resistant against an impact from the front, even when an impact of a frontal crash is applied to the part of the trunk pipe 41 adjoining the throttle valve 30 or the throttle valve 30 itself, the deformation of the trunk pipe 41 is minimized so that the rearward travel of the throttle valve 30 is minimized.

As shown in FIGS. 10*a* and 10*b*, when the load applied to the front side of the branch pipes 43 at the time of a frontal crash of the vehicle 2 is so large that one of the bolts 69A, 69B is broken, the second support member 51 is caused to rotate around the other remaining bolt 69A, 69B until the projecting piece 71 abuts on the stopper 72. As a result, a part of the load applied to the intake manifold 31 is absorbed by the fracture of one of the bolts 69A and 69B, and the friction between the second support member 51 and the support table 67 caused by the rotation of the second support member 51. Also, the rearward travel of the intake manifold 31 is limited. As a result, the transmission of load from the intake manifold 31 to the fuel delivery pipe 37 can be favorably controlled. It may be configured such that when the projecting piece 71 has abutted on the stopper 72, the intake manifold 31 connected to the second support member 51 is prevented from contacting the fuel delivery pipe 37. Further, when a load is applied from the front, the middle piece 86 and the port piece 87 constituting the intake manifold 31 deform and collapse in such a manner that a part of energy of the load is absorbed, and this reduces the deformation of the main piece 85. As a result, the intake manifold 31 is prevented from coming into contact with the fuel delivery pipe 37.

As shown in FIGS. 11*a* and 11*b*, when the load applied to the throttle valve 30 or the trunk pipe flange 46 at the time of a frontal crash of the vehicle 2 is large enough, the trunk pipe 41 is deformed or broken, the trunk pipe flange 46 and the throttle valve 30 that are joined to each other will move jointly rearward. At this time, the rearward movement of the trunk pipe flange 46 and the throttle valve 30 causes the connecting member 80 to pivot outward in the lateral direction of the vehicle around the bolt 81 (via which the connecting member 80 is coupled to the first support member 50), and the trunk pipe flange 46 and the throttle valve 30 are guided outward (leftward) in the lateral direction of the vehicle. When the trunk pipe flange 46 and the throttle valve 30 move rearward, the throttle valve 30 or the trunk pipe flange 46 abuts on the guide portion 65 of the first support member 50, and is guided by the guide portion 65 in the laterally outward direction (leftward direction) of the vehicle. Since the connecting member 80 and the guide portion 65 guide the throttle valve 30 and the trunk pipe flange 46 outward (leftward) in the lateral direction of the vehicle, the throttle valve 30 and the trunk pipe flange 46 are prevented from coming into contact with the fuel delivery pipe 37. Therefore, the need to provide an extra protection structure for the trunk pipe 41 and the throttle valve 30 can be eliminated. Also, due to deformation of the connecting member 80, a part of the load at the time of the frontal crash can be absorbed.

In the above embodiment, since the first support member 50 serves both as a structural member and as a passage forming member defining a passage connecting the internal EGR passage 34 with the trunk pipe 41, the number of component parts is reduced. The intake manifold 31 is provided with the left side fastening seat surface 53 extending from the intake chamber member 42 to the trunk pipe 41, and is fastened to the first support member 50 at the left side fastening seat surface 53 over a relatively large mounting surface so that the intake manifold 31 is made resistant to deformation against a frontal crash.

In the foregoing embodiment, when the load at the time of a front collision is applied to the second support member 51 via the intake manifold 31, one of the two bolts 69A and 69B may be broken. To predetermine which of the bolts 69A and 69B is to be broken, one of the bolts 69A and 69B may be provided with a lower mechanical strength than the other so that the pivot center for the second support member 51 at the time of a crash may be predetermined. The number of the bolts fastening the second support member 51 to the support table 67 is not limited to two, and may be three or more. In the foregoing embodiment, the rear end of the connecting member 80 is coupled to the first support member 50, but may also be directly coupled to the cylinder head 18. Further, the connecting member 80 may even be omitted.

Although the present invention has been described in terms of a preferred embodiment thereof, it is obvious to a person skilled in the art that various alterations and modifications are possible without departing from the scope of the present invention.

The invention claimed is:

1. An internal combustion engine for a vehicle, comprising:

an engine main body having an intake side disposed on a front side of the vehicle;

an intake manifold including a plurality of branch pipes extending from first ends attached to the intake side of the engine main body to second ends in a forward and upward direction along an arcuate path, an intake chamber member connected to the second ends of the branch pipes and elongated in a lateral direction of the vehicle and a trunk pipe extending from the intake chamber member in the lateral direction;

a fuel delivery pipe disposed between the intake side of the engine main body and the branch pipes and extending in the lateral direction;

a first support member connected to one end portion of the intake chamber member with respect to the lateral direction and the engine main body; and a second support member connected to another end portion of the intake chamber member remote from the one end portion with respect to the lateral direction and the engine main body.

2. The internal combustion engine according to claim 1, wherein the engine main body is formed with an internal EGR passage having an opening that opens out to the intake side of the engine main body, and an EGR introduction hole is formed in the trunk pipe, the first support member abutting the engine main body, the intake chamber member and the trunk pipe, and being provided with a connection passage communicating the internal EGR passage with the EGR introduction hole.

3. The internal combustion engine according to claim 2, wherein the one end portion of the intake chamber member and a part of the trunk pipe surrounding the EGR introduction hole jointly define a continuous fastening seat surface, and the first support member is fastened to the fastening seat surface.

4. The internal combustion engine according to claim 3, wherein the first support member includes a rear fastening portion formed in a rear part thereof to be fastened to the engine main body and a front fastening portion formed in a front part thereof to be fastened to the fastening seat surface, and wherein the front fastening portion projects upward relative to the rear fastening portion, and is connected to an upper surface of the rear fastening portion via a reinforcement rib.

5. The internal combustion engine according to claim 1, wherein the intake side of the engine main body is provided with a support table projecting forward and defining a planar upper surface, and the second support member is fastened to the upper surface of the support table via at least two vertically extending threaded bolts, and wherein the engine main body is provided with a stopper configured to abut the second support member when the second support member has rotated from an initial position toward the engine main body around one of the threaded bolts.

6. The internal combustion engine according to claim 5, wherein the second support member and the intake chamber member abut each other in a fore and aft direction of the vehicle.

7. The internal combustion engine according to claim 1, wherein the intake manifold is formed by a plurality of pieces, and the first support member and the second support member are both connected to a same one of the pieces of the intake manifold.

8. The internal combustion engine according to claim 7, wherein the one of the plurality of pieces of the intake manifold to which the first support member and the second support member are both connected has a greater stiffness than the other pieces, and is located in a rearmost part thereof.

* * * * *